US009155403B2

(12) United States Patent
Mountz et al.

(10) Patent No.: US 9,155,403 B2
(45) Date of Patent: Oct. 13, 2015

(54) CHILD MOTION APPARATUS

(71) Applicants: Jonathan K. Mountz, Geigertown, PA (US); Robert E. Haut, West Chester, PA (US); Nathanael Saint, Morgantown, PA (US); Peter R. Tuckey, Leola, PA (US)

(72) Inventors: Jonathan K. Mountz, Geigertown, PA (US); Robert E. Haut, West Chester, PA (US); Nathanael Saint, Morgantown, PA (US); Peter R. Tuckey, Leola, PA (US)

(73) Assignee: Wonderland Nurserygoods Company Limited, Hong Kong (HK)

( * ) Notice: Subject to any disclaimer, the term of this patent is extended or adjusted under 35 U.S.C. 154(b) by 73 days.

(21) Appl. No.: 13/941,003

(22) Filed: Jul. 12, 2013

(65) Prior Publication Data

US 2014/0018179 A1 Jan. 16, 2014

Related U.S. Application Data

(60) Provisional application No. 61/741,176, filed on Jul. 13, 2012.

(51) Int. Cl.

| | |
|---|---|
| ***A63G 9/16*** | (2006.01) |
| ***A47D 9/02*** | (2006.01) |
| ***A47D 13/10*** | (2006.01) |

(52) U.S. Cl.

CPC ..... *A47D 13/105* (2013.01); *A47D 9/02* (2013.01)

(58) Field of Classification Search

CPC ..... A63G 9/00; A63G 9/16; A47D 9/00; A47D 9/02; A47D 13/00; A47D 13/02; A47D 13/105

USPC ..... 472/118–125; 297/260.1, 260.2; 5/108, 5/109

See application file for complete search history.

(56) References Cited

U.S. PATENT DOCUMENTS

| | | | | |
|---|---|---|---|---|
| 7,824,273 | B2 * | 11/2010 | Clapper et al. | 472/95 |
| 7,845,728 | B2 | 12/2010 | Chen et al. | |
| 7,883,426 | B2 * | 2/2011 | Bellows et al. | 472/119 |
| 8,047,609 | B2 | 11/2011 | Chen et al. | |
| 8,197,005 | B2 | 6/2012 | Hopke et al. | |
| 8,239,984 | B2 | 8/2012 | Hopke et al. | |
| 8,845,440 | B2 * | 9/2014 | Haut | 472/119 |
| 2010/0201171 | A1 * | 8/2010 | Velderman et al. | 297/260.2 |

FOREIGN PATENT DOCUMENTS

| | | | |
|---|---|---|---|
| CN | 103315566 | A | 9/2013 |
| EP | 2617329 | A1 | 7/2013 |
| EP | 2641511 | A1 | 9/2013 |

OTHER PUBLICATIONS

Official Action from Chinese Patent Application No. 201310292226.9 dated Jul. 3, 2015.

* cited by examiner

*Primary Examiner* — Kien Nguyen
(74) *Attorney, Agent, or Firm* — David I. Roche; Baker & McKenzie LLP

(57) ABSTRACT

A child motion apparatus includes an upright column defining a vertical axis, a carriage assembled with the upright column and including a swing shaft portion operable to rotate about a pivot axis, a swing arm affixed with the swing shaft portion, a first motor drive unit assembled with the carriage and having an output shaft, a drive transmission respectively connected with the output shaft and the swing shaft portion, a second motor drive unit assembled with the upright column, and an actuating mechanism respectively connected with the second motor drive unit and the carriage. The drive transmission can transfer an output drive provided by the first motor drive unit at the output shaft to the swing shaft portion to impart rotation to the driven swing arm. The actuating mechanism is drivable by the second motor drive unit to vertically move the carriage relative to the upright column.

31 Claims, 17 Drawing Sheets

CHILD MOTION APPARATUS

CROSS-REFERENCE TO RELATED APPLICATION

This application claims priority to U.S. Provisional Patent Application No. 61/741,176 filed on Jul. 13, 2012, which is incorporated herein by reference.

BACKGROUND

1. Field of the Invention

The present inventions relate to child motion apparatuses.

2. Description of the Related Art

Swing apparatuses can be used by parents to help calming or entertaining a child. A child swing apparatus typically travels at a natural frequency in a pendulum motion. The drive system for the swing apparatus is generally located at the pivot point of the pendulum at a high location in the frame structure of the swing apparatus, and the pivot point is generally fixed relative to the swing frame. While the conventional pendulum motion requires driving at the point of highest torque, the system can store the potential energy from one half cycle to another, requiring only a soft push or pull to maintain or increase the amplitude.

However, a few drawbacks may exist in the conventional swing apparatuses. In particular, the swinging motion and frequency are generally locked as a function of the length of the swing arm. If a slower frequency is needed along a same motion path, it may be extremely difficult to exert a driving torque for overcoming the gravitational force acting in the pendulum motion. Accordingly, the drive systems applied in most of the currently available swing apparatuses cannot allow truly adjustable swinging frequency and have a limited range of movement paths.

Therefore, there is a need for an improved structure that can address at least the aforementioned issues.

SUMMARY

The present application describes a child motion apparatus that has multiple drive systems. The child motion apparatus includes an upright column defining a vertical axis, a carriage assembled for up and down movements relative to the upright column, wherein the carriage includes a swing shaft portion operable to rotate about a pivot axis, a driven swing arm affixed with the swing shaft portion, a first motor drive unit assembled with the carriage and having an output shaft, a drive transmission respectively connected with the output shaft and the swing shaft portion, a second motor drive unit assembled with the upright column, and an actuating mechanism respectively connected with the second motor drive unit and the carriage. The drive transmission is operable to transfer a first output drive provided by the first motor drive unit at the output shaft to the swing shaft portion to impart reciprocated rotation to the driven swing arm about the pivot axis. The actuating mechanism is drivable by the second motor drive unit to vertically move the carriage relative to the upright column.

DETAILED DESCRIPTION OF THE EMBODIMENTS

Figure 1:
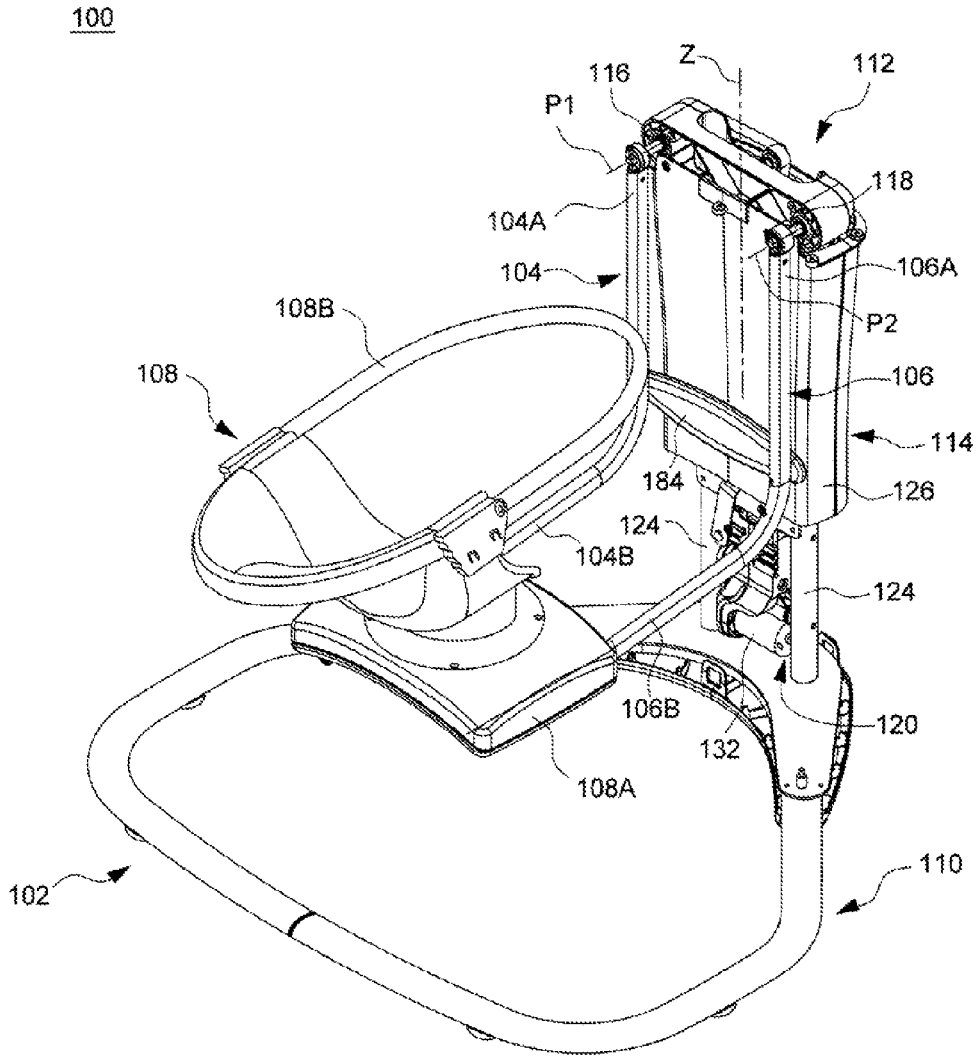
FIG. 1 is a schematic view illustrating an embodiment of a child motion apparatus.

FIG. 1 is a schematic view illustrating an embodiment of a child motion apparatus 100. The child motion apparatus 100 can include a support frame 102, one or more swing arm (two swing arms 104 and 106 are shown in the illustrated embodiment) and a seat support 108. The support frame 102 can include a base frame 110 extending along a horizontal plane, and an upright column 112 projecting along a vertical axis Z perpendicular to the horizontal plane of the base frame 110. The base frame 110 can provide stable resting support on a ground and below the seat support 108. The upright column 112 can have a lower end connected with the base frame 110, and an upper portion assembled with the swing arms 104 and 106. For facilitating storage, some embodiments of the child motion apparatus 100 can implement a detachable construction in which the upright column 112 can be desirably detached from and attached with the base frame 110.

The embodiment shown in FIG. 1 exemplary includes two swing arms 104 and 106. However, other embodiments of the child swing apparatus may also use one swing arm, e.g., the swing arm 104. The swing arm 104 can be formed as an assembly of bent tubes, including a vertical segment having an upper end portion 104A that is assembled with the support frame 102 about a pivot axis P1, and a horizontal segment 104B that extends below the upper end portion 104A and is connected with the seat support 108. Likewise, the swing arm 106 can be formed as an assembly of bent tubes, including a vertical segment having an upper end portion 106A that is assembled with the support frame 102 about a pivot axis P2, and a horizontal segment 106B that extends below the upper end portion 106A and is connected with the seat support 108. The pivot axes P1 and P2 are parallel and horizontally spaced apart from each other, and are arranged at the same height. The swing arms 104 and 106 can thereby swing about the pivot axes P1 and P2, and hold the seat support 108 at a height above the ground.

The support frame 102 may include a carriage 114 movably assembled with the upright column 112. The carriage 114 can be assembled with two horizontally spaced-apart swing shaft portions 116 and 118 about which the first end portions 104A and 106A of the swing arms 104 and 106 can be respectively affixed. A motor drive unit 120 (better shown in FIGS. 2 and 3) can be provided to move the carriage 114 vertically along the upright column 112. Accordingly, displacement of the carriage 114 along the vertical axis Z of the upright column 112 can impart vertical motion to the swing arms 104 and 106 and the seat support 108 along the vertical axis Z. Moreover, the swing shaft portions 116 and 118 can be operatively connected with another motor drive unit 122 (better shown in FIG. 3) that is assembled with the carriage 114. The motor drive unit 122 can be operable independently from the motor drive unit 120 to drive rotation of the swing shaft portions 116 and 118 so as to impart swing motion to the swing arms 104 and 106.

Referring again to FIG. 1, the seat support 108 can include a lower portion 108A connected with the swing arms 104 and 106, and an upper portion 108B for receiving a child. The lower portion 108A of the seat support 108 can be affixed or pivotally connected with the horizontal segments 104B and 106B of the swing arms 104 and 106. The upper portion 108B can be permanently affixed with the lower portion 108A, or can be provided as a portable holding device that can be attached with and detached from the lower portion 108A. In some embodiments, the upper portion 108B of the seat support 108 can also be adjustable to different orientations relative to the swing arms 104 and 106, so that a child sitting on the seat support 108 can be swung sideways or back and forth.

Figure 2:
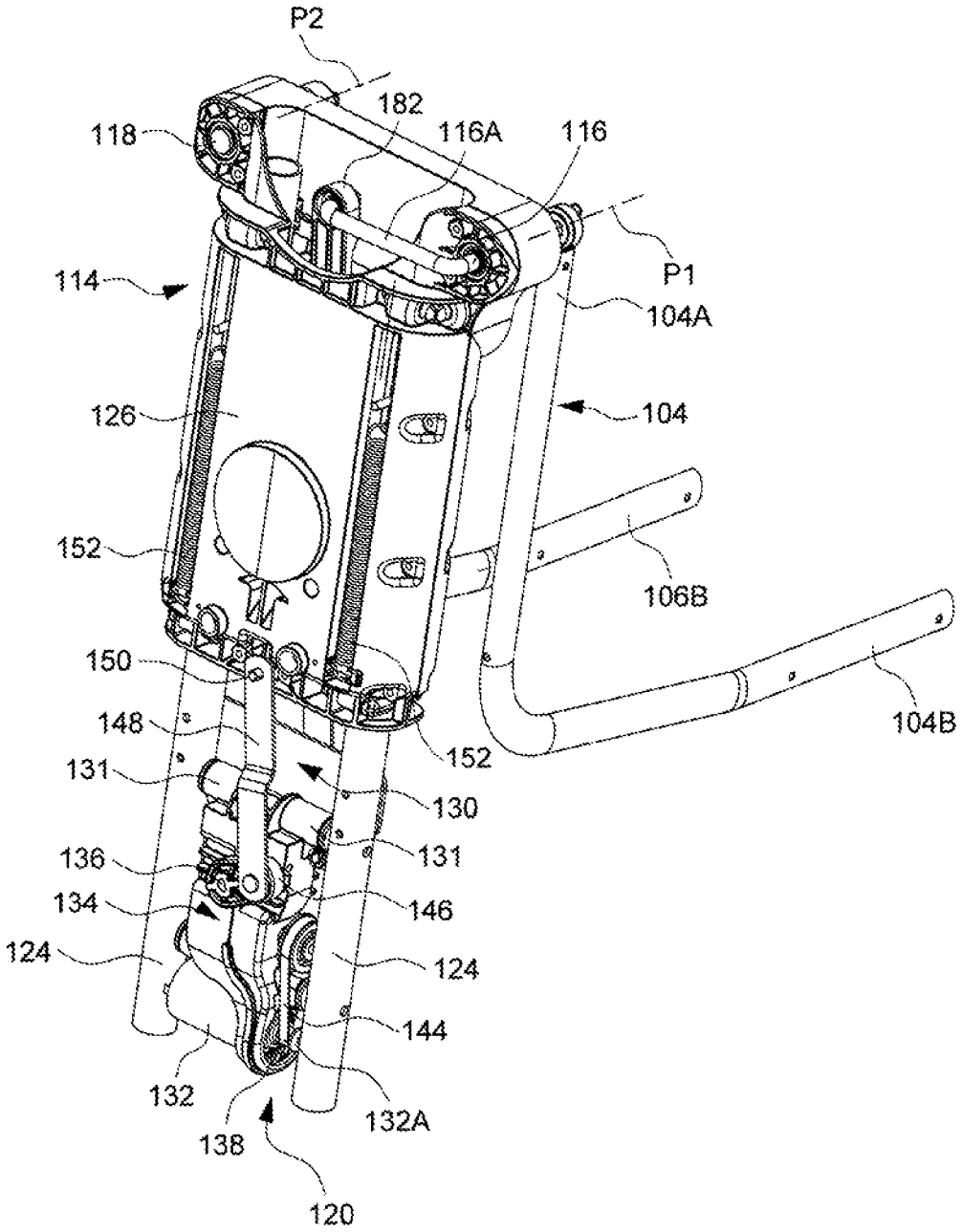
FIG. 2 is a schematic view illustrating the construction of a carriage and a upright column in the child motion apparatus.
Figure 3:
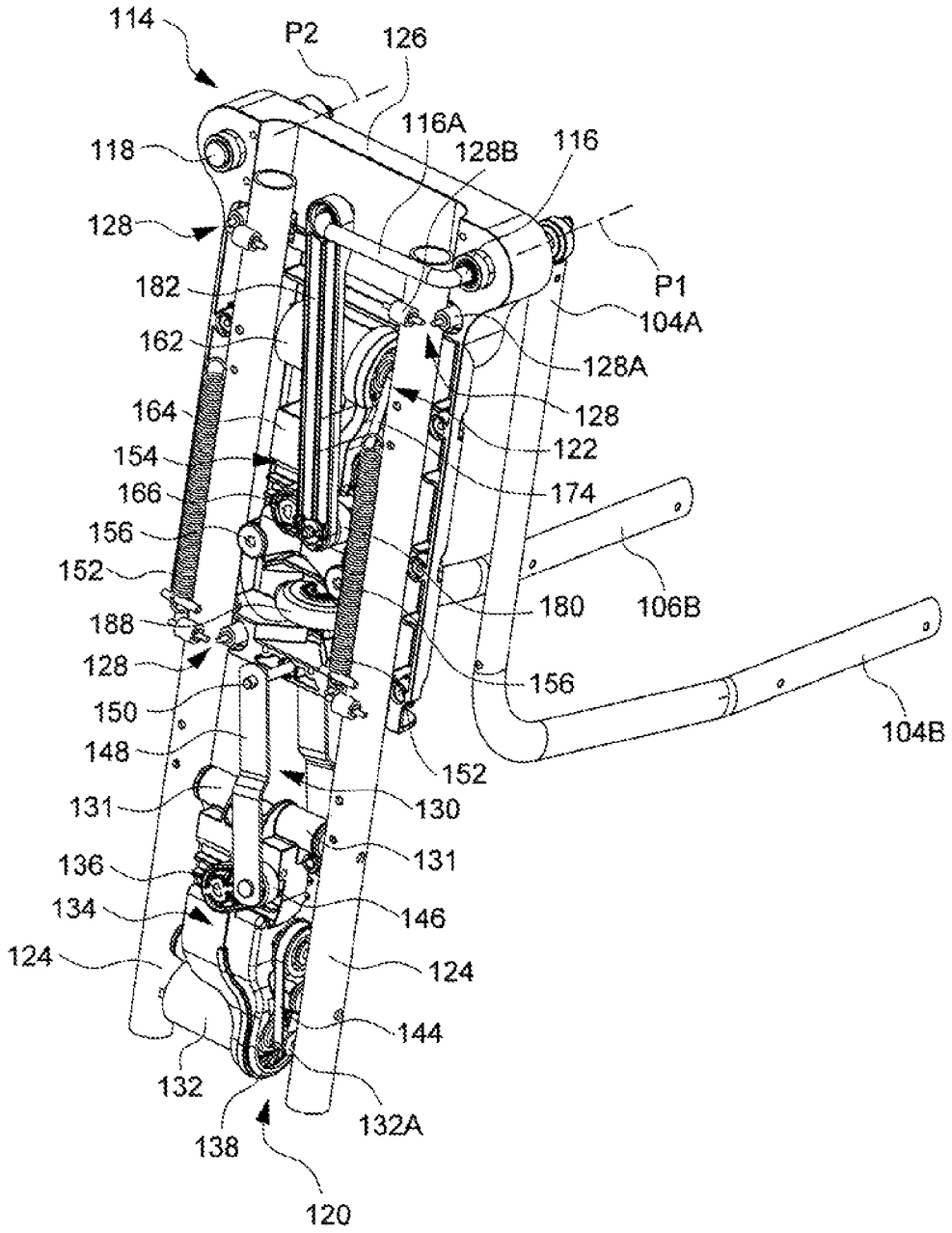
FIG. 3 is a schematic view illustrating more details of drive systems for controlling a vertical and swing movements of a seat support in the child motion apparatus.

In conjunction with FIG. 1, FIG. 2 is a schematic view illustrating the construction of the carriage 114 and upright column 112, and FIG. 3 is a schematic view illustrating more details of drive systems implemented in the child motion apparatus 100. The upright column 112 can include one or more tube segments 124 (two tube segments 124 are exemplary illustrated in the drawings). The tube segments 124 can extend vertically spaced apart from each other, and can have lower ends affixed with the base frame 110. The tube segments 124 can be made of rigid metal alloys, such as steel.

The carriage 114 can be assembled for vertical movements along the tube segments 124. In one embodiment, the carriage 114 can include a housing 126 and a plurality of roller bearings 128. The tube segments 124 can extend vertically through the housing 126 of the carriage 114. The roller bearings 128 can be assembled with the housing 126, and can be in rolling contact with the tube segments 124. For example, the housing 126 can include four roller bearings 128, two first roller bearings 128 being vertically spaced apart from each other and in rolling contact with one tube segment 124, and two second roller bearings 128 being vertically spaced apart from each other and in rolling contact with the other tube segment 124. Each of the roller bearings 128 can include a lateral roller 128A in rolling contact with an outer side portion of one tube segment 124, and a rear roller 128B in rolling contact with a rear portion of the tube segment 124. The rolling contact of the roller bearings 128 can facilitate displacement of the carriage 114 along the upright column 112.

Figure 4:
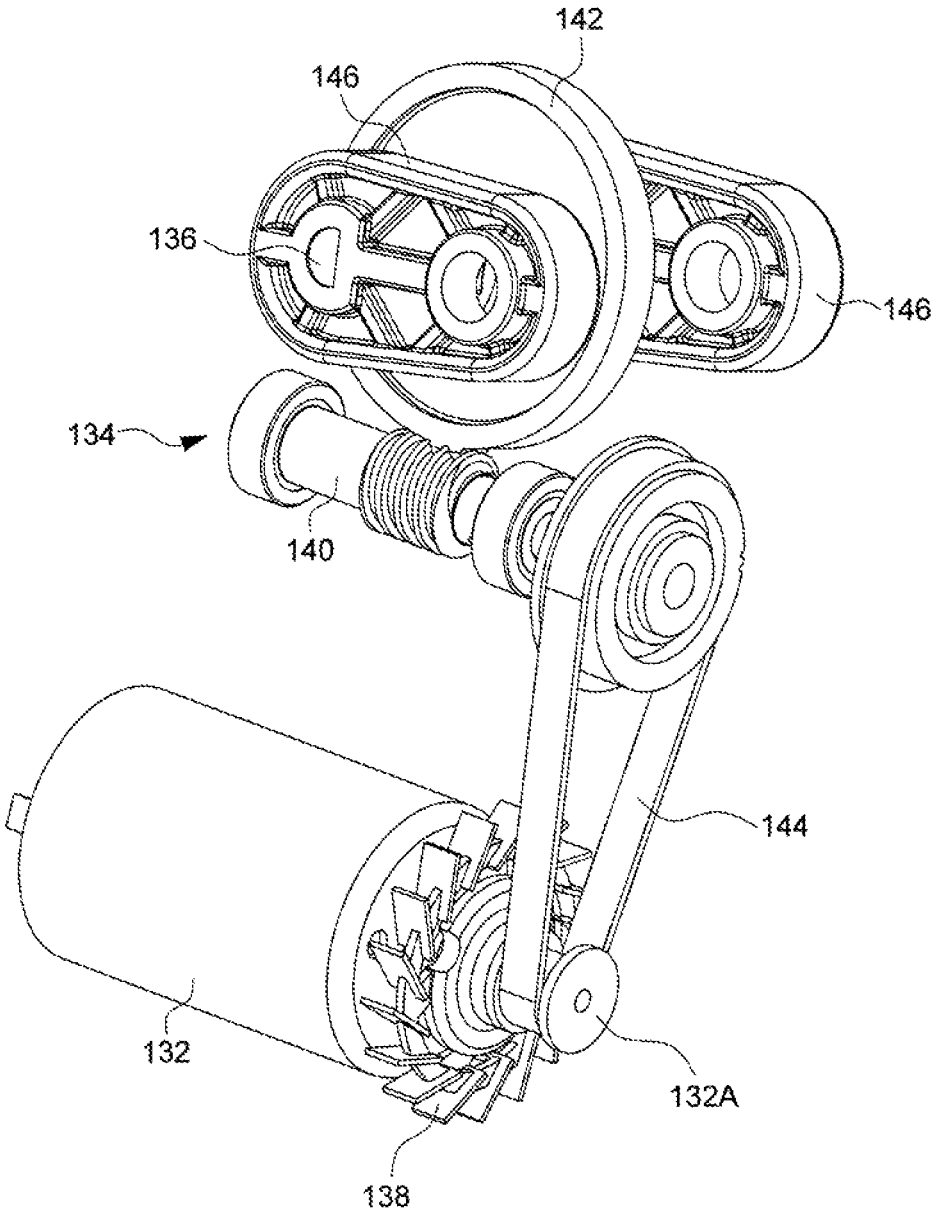
FIG. 4 is a schematic view illustrating a portion of a motor drive unit for driving vertical movements of a carriage in the child motion apparatus.

In conjunction with FIGS. 2 and 3, FIG. 4 is a schematic view illustrating a portion of the motor drive unit 120. Referring to FIGS. 2-4, the motor drive unit 120 can drive vertical movements of the carriage 114 relative to the upright column 112 via an actuating mechanism 130 that is respectively connected with the motor drive unit 120 and the carriage 114. The motor drive unit 120 can be assembled with the upright column 112 at a position below the carriage 114. For example, the motor drive unit 120 can be securely assembled with the tube segments 124 via a plurality of rubber bushings 131 that can isolate the movable component parts of the motor drive unit 120 from direct contact with the tube segments 124.

The motor drive unit 120 can include a motor 132 having a motor shaft 132A, a gear box 134, an output shaft 136, and a fan 138. Examples of the motor 132 can include a DC motor that may be controlled by a pulse width modulation (PWM) controller. The motor shaft 132A may lie in a transversal direction relative to the two tube segments 124. As shown in FIG. 4, the gear box 134 can include a worm gear 140, and a gear 142 that is affixed with the output shaft 136 and is meshed with the worm gear 140. The output shaft 136 may extend substantially parallel to the pivot axes P1 and P2, and substantially orthogonal to the motor shaft 132A. The motor shaft 132A can be coupled with the worm gear 140 via a transmission belt 144. Rotation of the motor shaft 132A can be thereby transmitted via the transmission belt 144 to the worm gear 140, which in turn drives rotation of the gear 142 and the output shaft 136.

The fan 138 can be coupled with the motor shaft 132A. When the motor 132 is activated, the fan 138 can rotate with the motor shaft 132A to draw air flow into the gear box 134 so that the component parts of the gear box 134 (e.g., including the worm gear 140 and the gear 142) can be cooled down.

The actuating mechanism 130 can include one or more crank 146, and one or more connecting rod 148. The crank 146 can be affixed with the output shaft 136. The connecting rod 148 can have one end pivotally connected with an eccentric portion of the crank 146, and another opposite end pivotally connected with a pin 150 that is affixed with the carriage 114. Rotation of the output shaft 136 driven by the motor drive unit 120 can be converted into a linear vertical movement of the carriage 114 and the swing arms 104 and 106 via the crank 146 and the connecting rod 148.

As shown in FIG. 2, one or more spring 152 can be further provided to apply an upward biasing force to the carriage 114. In one embodiment, two springs 152 can be respectively assembled with the tube segments 124 of the upright column 112 and the carriage 114. Each of the springs 152 can have a lower end connected with the carriage 114, and an upper end connected with one corresponding tube segment 124. The springs 152 can provide a counterbalance force that pulls up against gravity to assist the motor drive unit 120 in lifting the weight of the swing arms 104 and 106 and the seat support 108.

Figure 5:
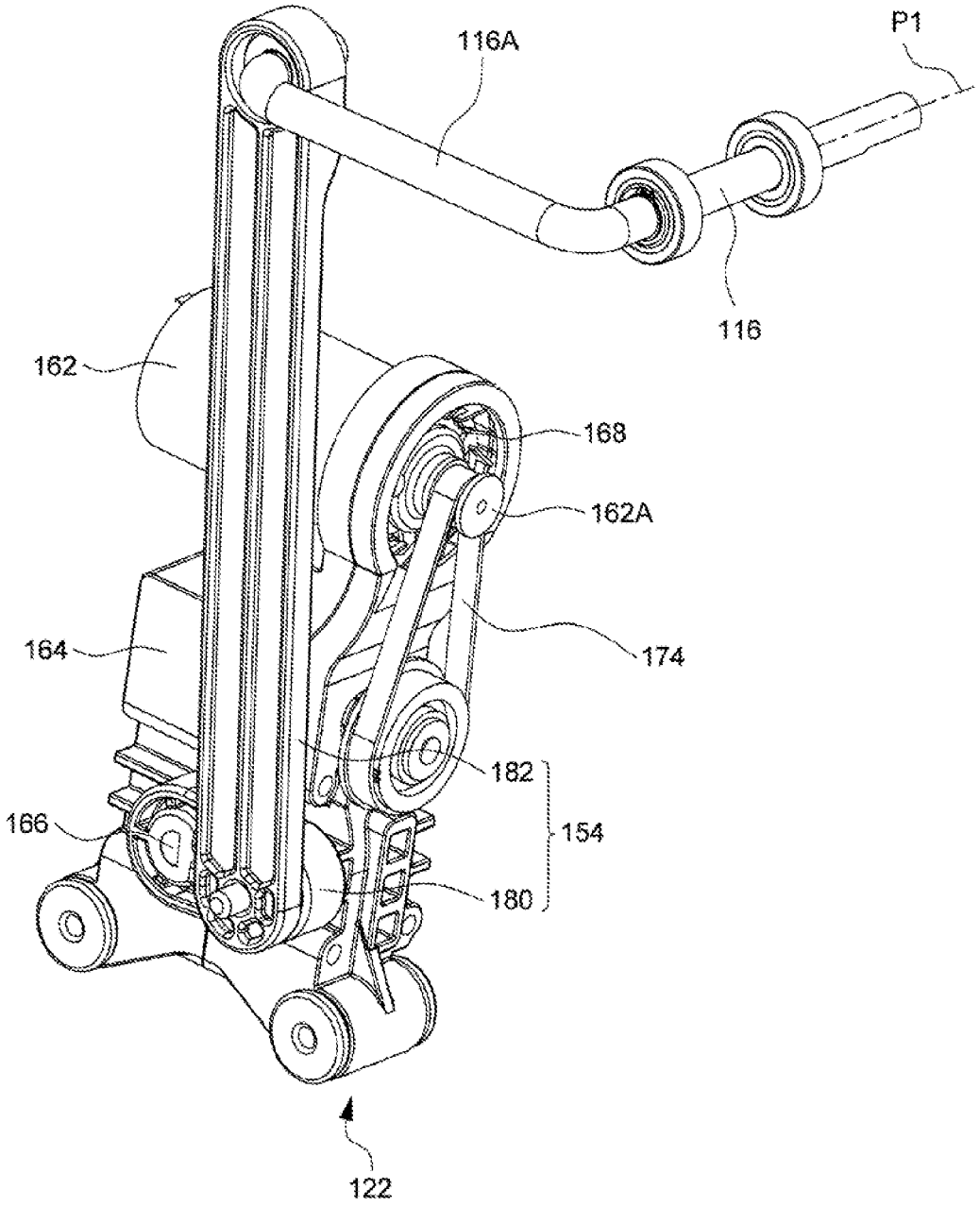
FIG. 5 is a schematic view illustrating a drive system associated with one swing arm.
Figure 6:
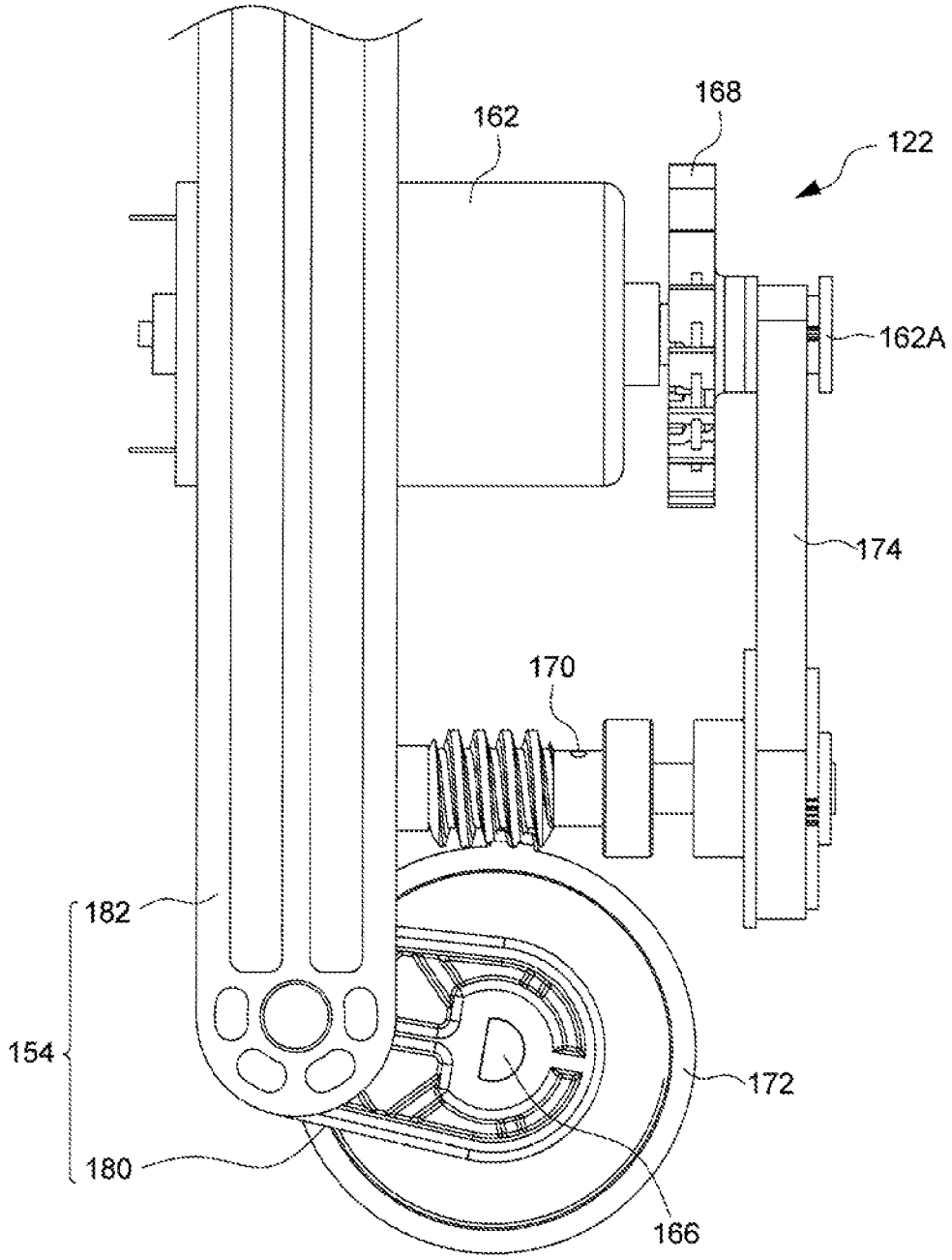
FIG. 6 is a schematic view illustrating a portion of a motor drive unit for driving displacement of the swing arm.

In conjunction with FIGS. 2 and 3, FIG. 5 is a schematic view illustrating the drive system for controlling the swing motion of one swing arm 104, and FIG. 6 is a schematic view illustrating a portion of the motor drive unit 122 driving displacement of the swing arm 104. Referring to FIGS. 2, 3, 5 and 6, a drive transmission 154 can be connected with the motor drive unit 122 and at least one of the two swing shaft portions 116 and 118, e.g., the swing shaft portion 116. The drive transmission 154 can transfer an output drive provided by the motor drive unit 122 to impart rotation to the swing arms 104 and 106. The motor drive unit 122 can be assembled with the carriage 114 at a position above the motor drive unit 120. For example, the motor drive unit 122 can be securely assembled with the housing 126 via a plurality of rubber bushings 156 that can isolate the movable component parts of the motor drive unit 122 from direct contact with the housing 126.

In one embodiment, the motor drive unit 122 can have a construction similar to that of the motor drive unit 120. The motor drive unit 122 can include a motor 162 having a motor shaft 162A, a gear box 164, an output shaft 166, and a fan 168. Examples of the motor 162 can include a DC motor that may be controlled by a pulse width modulation (PWM) controller. The motor shaft 162A can lie in a transversal direction relative to the tube segments 124. The gear box 164 can include a worm gear 170, and a gear 172 that is affixed with the output shaft 166 and is meshed with the worm gear 170. The output shaft 166 may extend substantially parallel to the pivot axes P1 and P2, and substantially orthogonal to the motor shaft 162A. The motor shaft 162A can be coupled with the worm gear 170 via a transmission belt 174. Rotation of the motor shaft 162A can be thereby transmitted via the transmission belt 174 to the worm gear 170, which in turn drives rotation of the gear 172 and the output shaft 166. The fan 168 can also be coupled with the motor shaft 162A, so that activation of the motor 162 can cause rotation of the fan 168 to draw cooling air flow into the gear box 164.

The swing shaft portion 116 can include a radial extension 116A projecting along a radial direction relative to the pivot axis P1, and the drive transmission 154 can be pivotally connected with the radial extension 116A of the swing shaft portion 116. The drive transmission 154 can be similar to the actuating mechanism 130 in construction. The drive transmission 154 can include a crank 180, and a connecting rod 182. The crank 180 can be affixed with the output shaft 166. The connecting rod 182 can have one end pivotally connected with an eccentric portion of the crank 180, and another opposite end pivotally connected with the radial extension 116A of the swing shaft portion 116. Rotation of the output shaft 166 driven by the motor drive unit 122 can be thereby transferred to the swing shaft portion 116 via the crank 180 and the connecting rod 182 of the drive transmission 154 to impart a swing motion to the swing arm 104.

Referring to FIGS. 1 and 3, the two swing arms 104 and 106 can be connected with a linkage member 184. In one embodiment, the linkage member 184 can be exemplary a plate that is respectively connected pivotally with the vertical segments of the swing arms 104 and 106. Motion of the swing arm 104 can be thereby transmitted via the linkage member 184 to the swing arm 106.

The carriage 114 can further include a roller 188 that is mounted about a pivot shaft capable of free rotation at a location lower than the pivot axes P1 and P2. The roller 188 can extend through an opening of the housing 126 and can be in rolling contact with the linkage member 184. The rolling contact between the roller 188 and the linkage member 184 can allow the highly loaded swing arms 104 and 106 to rest and balance against a lower point on the upright column 112.

With the aforementioned construction, all of the component parts of the actuating mechanism 130 (including the crank 146 and the connecting rod 148) and all of the component parts of the drive transmission 154 (including the crank 180 and the connecting rod 182) can move in vertical planes that are all substantially parallel to the plane in which the swing arms 104 and 106 move. Accordingly, the assembly of the actuating mechanism 130 and the drive transmission 154 can be made in a compact space.

Figure 7:
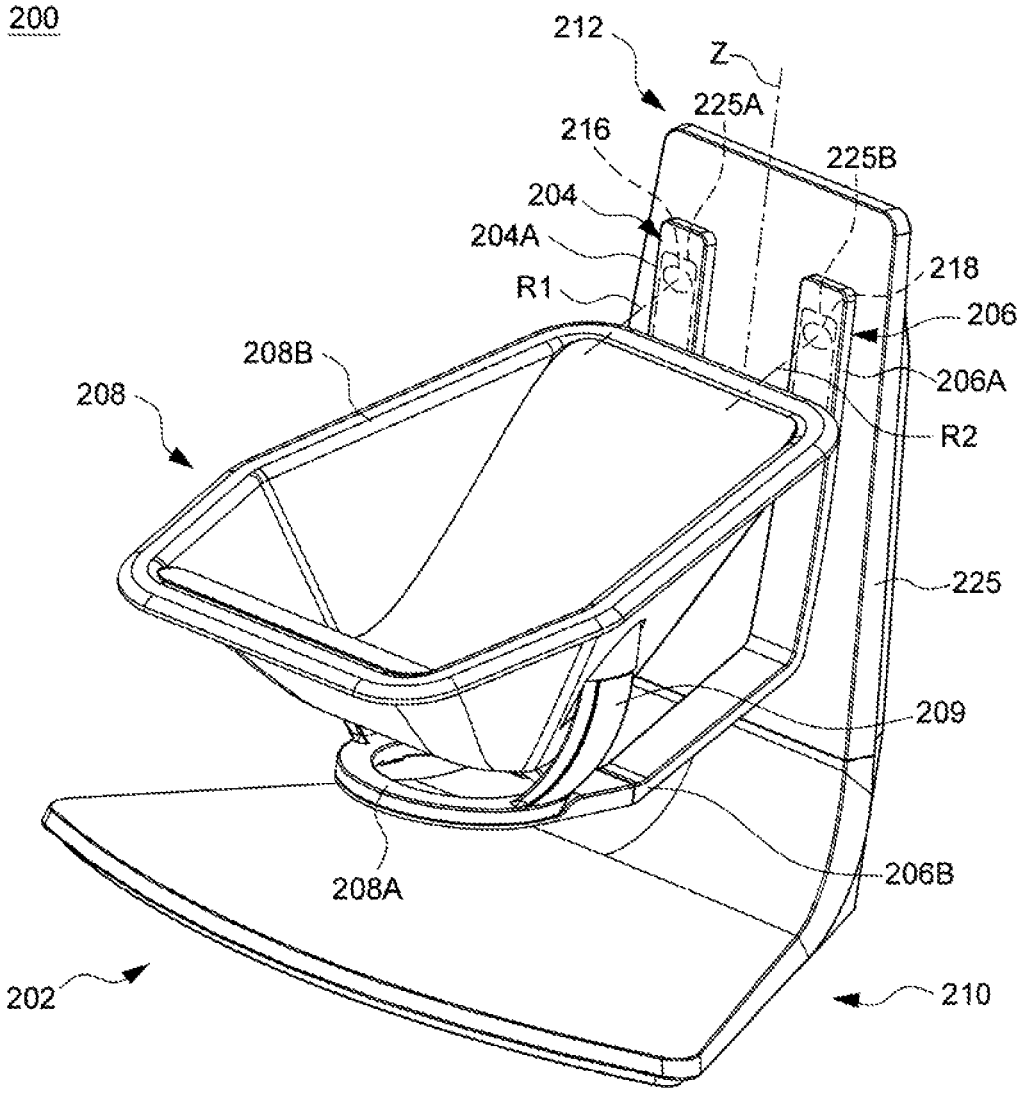
FIG. 7 is a schematic view illustrating another embodiment of a child motion apparatus.
Figure 8:
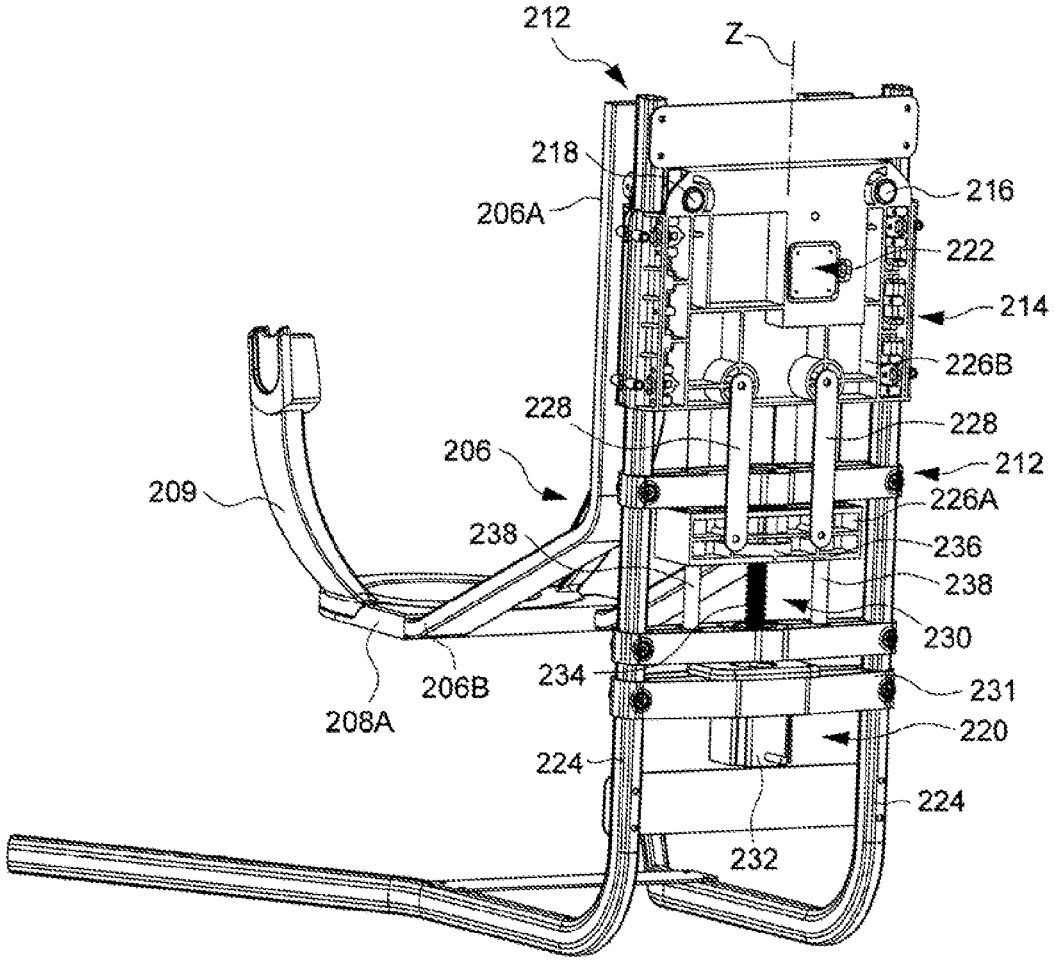
FIG. 8 is a schematic view illustrating the construction of drive systems provided in the child motion apparatus shown in FIG. 7.
Figure 9:
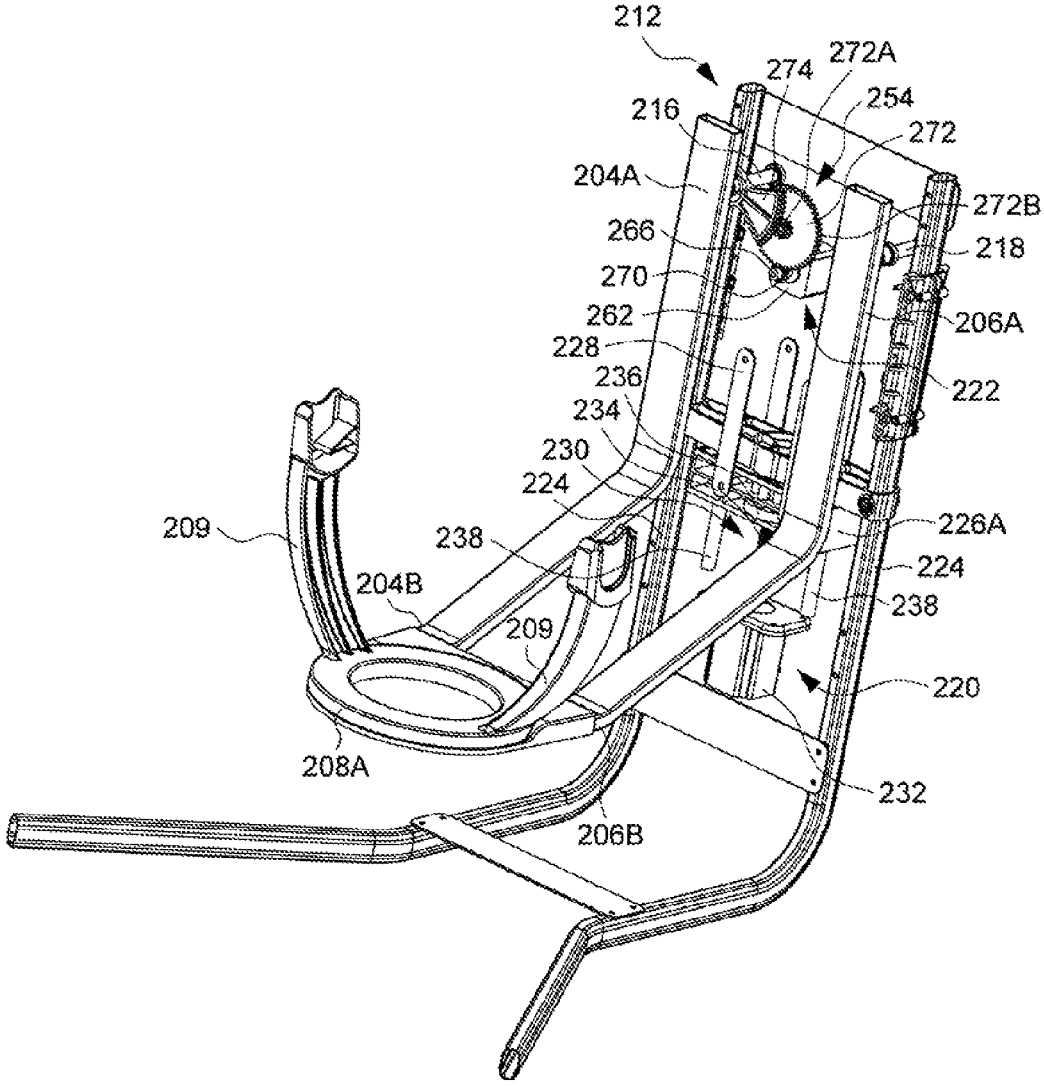
FIG. 9 is a schematic view taken under another perspective illustrating the construction of the drive systems implemented in the child motion apparatus shown in FIG. 7.

FIGS. 7-9 are schematic views illustrating another embodiment of a child motion apparatus 200. The child motion apparatus 200 can include a support frame 202, one or more swing arm (two swing arms 204 and 206 are shown in the illustrated embodiment) and a seat support 208. The support frame 202 can include a base frame 210 extending along a horizontal plane, and an upright column 212 projecting along the vertical axis Z perpendicular to the horizontal plane of the base frame 210. The base frame 210 can provide stable resting support on a ground and below the seat support 208. The upright column 212 can have a lower end connected with the base frame 210, and an upper portion assembled with the swing arms 204 and 206.

The embodiment shown in FIG. 7 exemplary includes two swing arms 204 and 206. However, other embodiments of the child swing apparatus may also use one swing arm, e.g., the swing arm 204. The swing arm 204 can be formed as an assembly of bent tubes, including a vertical segment having an upper end portion 204A that is assembled with the upright column 212 of the support frame 202 about a pivot axis R1, and a horizontal segment 204B that extends below the upper end portion 204A and is connected with the seat support 208. Likewise, the swing arm 206 can be formed as an assembly of bent tubes, including a vertical segment having an upper end portion 206A that is assembled with the upright column 212 of the support frame 202 about a pivot axis R2, and a horizontal segment 206B that extends below the upper end portion 206A and is connected with the seat support 208. The pivot axes R1 and R2 are parallel and horizontally spaced apart from each other, and are arranged at the same height. The swing arms 204 and 206 can thereby swing about the pivot axes R1 and R2, and hold the seat support 208 at a height above the ground.

The support frame 202 may include a carriage 214 movably assembled with the upright column 212. The carriage 214 can be assembled with two horizontally spaced-apart swing shaft portions 216 and 218 about which the first end portions 204A and 206A of the swing arms 204 and 206 are respectively affixed. A motor drive unit 220 (better shown in FIGS. 8 and 9) can be provided to move the carriage 214 vertically along the upright column 212. Accordingly, displacement of the carriage 214 along the vertical axis Z of the upright column 212 can impart vertical motion to the swing arms 204 and 206 and the seat support 208 along the vertical axis Z. Moreover, the swing shaft portions 216 and 218 can be operatively connected with another motor drive unit 222 (better shown in FIGS. 8 and 9) that is assembled with the carriage 214. The motor drive unit 222 can be operable to drive rotation of the swing shaft portions 216 and 218 so as to impart swing motion to the swing arms 204 and 206.

Referring again to FIG. 7, the seat support 208 can include a lower portion 208A connected with the swing arms 204 and 206, and an upper portion 208B for receiving a child. The lower portion 208A of the seat support 208 can be connected with the horizontal segments 204B and 206B of the swing arms 204 and 206. The upper portion 208B can be permanently affixed with the lower portion 208A, or can be provided as a portable holding device that can be attached with and detached from the lower portion 208A. For example, the lower portion 208A can include a plurality of support arms 209 on which the upper portion 208B can be detachably installed. In some embodiments, the upper portion 208B of the seat support 208 can also be adjustable to different orientations relative to the swing arms 204 and 206, so that a child sitting on the seat support 208 can be swung sideways or back and forth.

Referring to FIGS. 7-9, the upright column 212 can include one or more tube segments 224 (two tube segments 224 are exemplary illustrated in the drawings), and an outer casing 225 substantially enclosing the tube segments 224 and the carriage 214. The tube segments 224 can extend vertically spaced apart from each other, and can have lower ends affixed with the base frame 210. The tube segments 224 can be made of rigid metal alloys, such as steel. The outer casing 225 can include two elongated slots 225A and 225B (shown with dotted lines on FIG. 7) along which the swing shaft portions 216 and 218 can be guided for vertical displacement along the axis Z.

The carriage 214 can be assembled for vertical movements along the tube segments 224 inside the outer casing 225. In one embodiment, the carriage 214 can include two housing portions 226A and 226B spaced apart from each other (the representation of the housing portion 226B is shown in FIG. 8 but omitted in FIG. 9 for clarity), and one or more bar linkage 228. The tube segments 224 can extend vertically through the housing portion 226B of the carriage 214. The bar linkage 228 can be affixed with the two housing portions 226A and 226B, so that the housing portions 226A and 226B can move together vertically along the tube segments 224. A plurality of roller bearings (not shown) may also be provided in rolling contact with the tube segments 224 for facilitating the vertical displacement of the carriage 214.

The motor drive unit 220 can drive vertical movements of the carriage 214 relative to the upright column 212 via an actuating mechanism 230 that is respectively connected with the motor drive unit 220 and the carriage 214. The motor drive unit 220 can be assembled with the tube segments 224 of the upright column 212 at a position below the carriage 214. For example, the motor drive unit 220 can be securely assembled with a transversal frame 231 that is affixed with the tube segments 224.

The motor drive unit 220 can include a motor 232 having a motor output shaft extending vertically. Examples of the motor 232 can include a DC motor that may be controlled by a pulse width modulation (PWM) controller.

The actuating mechanism 230 can include a screw 234 that extends vertically and is coupled with the output shaft of the motor 232, and a threaded portion 236 (e.g., including a threaded opening) that is affixed with the carriage 214 and is meshed with the screw 234. For example, the threaded portion 236 can be provided in the housing portion 226A. Accordingly, rotation of the screw 234 driven by the motor drive unit 220 can cause vertical displacements of the carriage 214 relative to the upright column 212. In one embodiment, the transversal frame 231 can also be affixed with two guide tubes 238 that extend vertically through the housing portion 226A at two sides of the threaded portion 236. The guide tubes 238 can provide a guide structure for facilitating the vertical movement of the housing portion 226A.

Referring again to FIGS. 7-9, a drive transmission 254 can be connected with the motor drive unit 222 and at least one of the two swing shaft portions 216 and 218, e.g., the swing shaft portion 216. The drive transmission 254 can transfer an output drive provided by the motor drive unit 222 to impart rotation to the swing arms 204 and 206. The motor drive unit 222 can be assembled with the carriage 214 at a position above the motor drive unit 220. For example, the motor drive unit 222 can be securely assembled with the housing portion 226B of the carriage 214.

The motor drive unit 222 can include a motor 262, and an output shaft 266 coupled with the motor 262. Examples of the motor 262 can include a DC motor that may be controlled by a pulse width modulation (PWM) controller. The output shaft 266 may extend substantially parallel to the pivot axes R1 and R2 of the swing arms 204 and 206.

The drive transmission 254 can include a gear 270 coupled with the output shaft 266 of the motor 262, a double-gear member 272 pivotally connected with the housing portion 226B of the carriage 214, and a gear member 274 affixed with the swing shaft portion 216. The double-gear member 272 can have a pivot axis that is parallel to the pivot axes R1 and R2, and can include a first gear portion 272A of a smaller diameter and a second gear portion 272B of a greater diameter. The first gear portion 272A of the double gear member 272 can be meshed with the gear member 274, and the second gear portion 272B of the double gear member 272 can be meshed with the gear 270. Rotation of the output shaft 266 driven by the motor drive unit 222 can be thereby transferred to the swing shaft portion 216 via the gear train comprised of the gear 270, the double-gear member 272 and the gear member 274 to impart a swing motion to the swing arm 204. The motion of the swing arm 204 in turn can be transmitted to swing arm 206 via the lower portion 208A of the seat support 208. The two swing arms 204 and 206 can thereby move in unison to swing the seat support 208.

In the embodiment shown in FIGS. 7-9, all the component parts of the drive transmission 254 (including the gear 270, the double-gear member 272 and the gear member 274) can move in vertical planes that are all substantially parallel to a plane in which the swing arms 104 and 106 swing. Moreover, the vertical displacement of the carriage 214 is conducted by the actuating mechanism 230 that can be constructed as a linear actuator (including the screw 234 and the threaded portion 236) compactly disposed in a vertical arrangement.

The drive systems as described previously can drive motion of the swing arms at an adjustable frequency in a vertical plane defined by the axes X and Z that is perpendicular to the pivot axes of the swing arms. As exemplary shown in FIGS. 10-17, the motions induced by the drive mechanisms described herein can allow a wide range of programmable motions.

Figure 10:
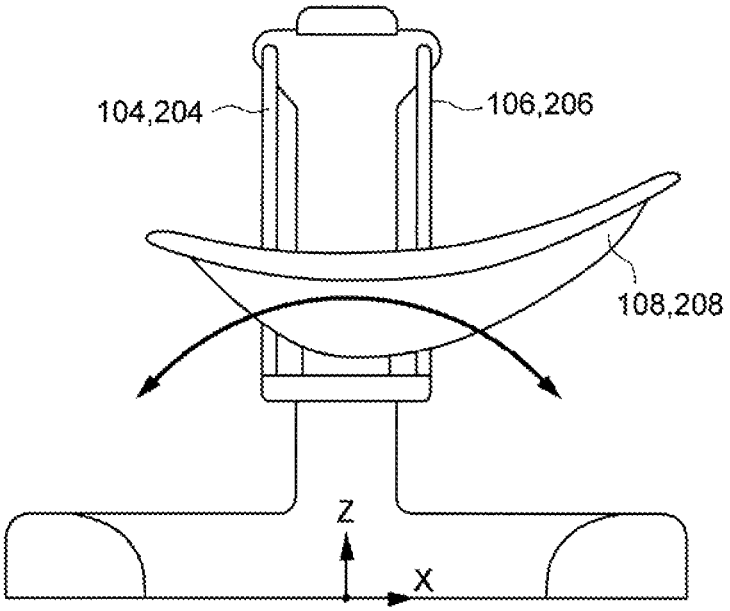
FIG. 10 is a schematic view illustrating a rainbow motion implemented in the child motion apparatus.

In FIG. 10, the arrow represents a "rainbow" motion in which the seat support 108, 208 is at a relatively higher point when it is aligned with the upright column, and progressively descends from the higher point toward the left and right ends of the travel.

Figure 11:
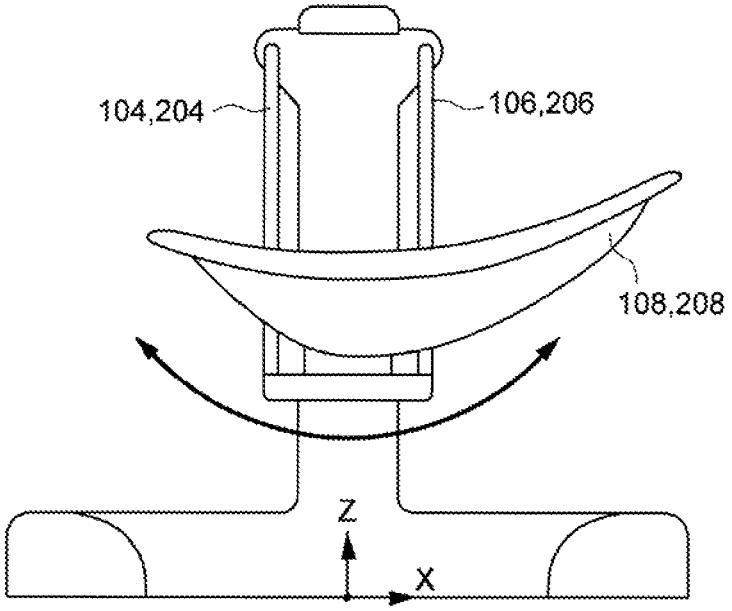
FIG. 11 is a schematic view illustrating a swing motion implemented in the child motion apparatus.

In FIG. 11, the arrow represents a "swing" motion in which the seat support 108, 208 is at a relatively lower point when it is aligned with the upright column, and progressively ascends from the lower point toward the left and right ends of the travel.

Figure 12:
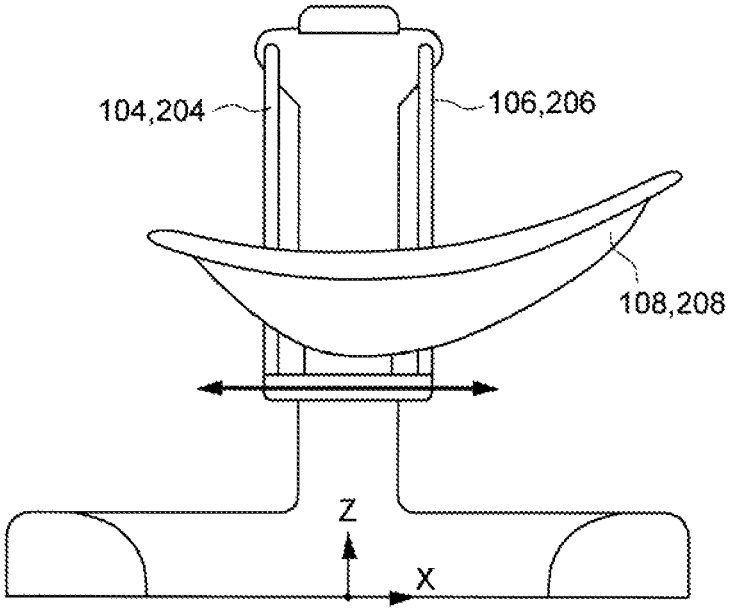
FIG. 12 is a schematic view illustrating a glide motion implemented in the child motion apparatus.

In FIG. 12, the arrow represents a "glide" motion in which the seat support 108, 208 travels only horizontally to the left and right.

Figure 13:
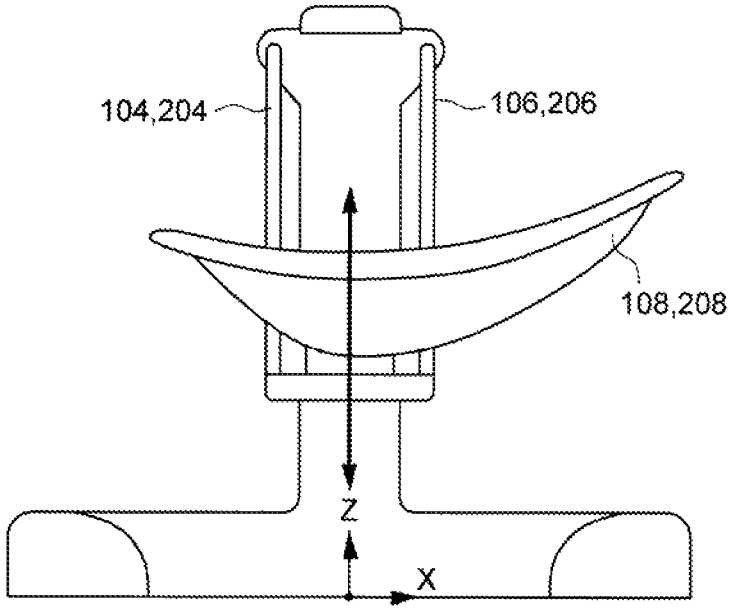
FIG. 13 is a schematic view illustrating a vertical motion implemented in the child motion apparatus.

In FIG. 13, only the carriage is driven in movement so as to impart a motion of the seat support 108, 208 along the vertical axis Z.

Figure 14:
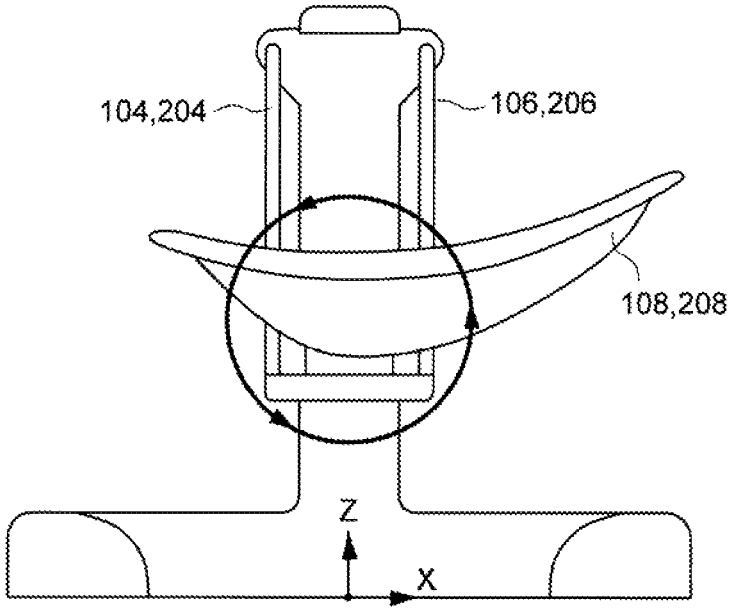
FIG. 14 is a schematic view illustrating an orbital motion implemented in the child motion apparatus.

In FIG. 14, the arrow represents an "orbital" motion in which the seat support 108, 208 travels along a circular path in the vertical plane defined by the axes X and Z.

Figure 15:
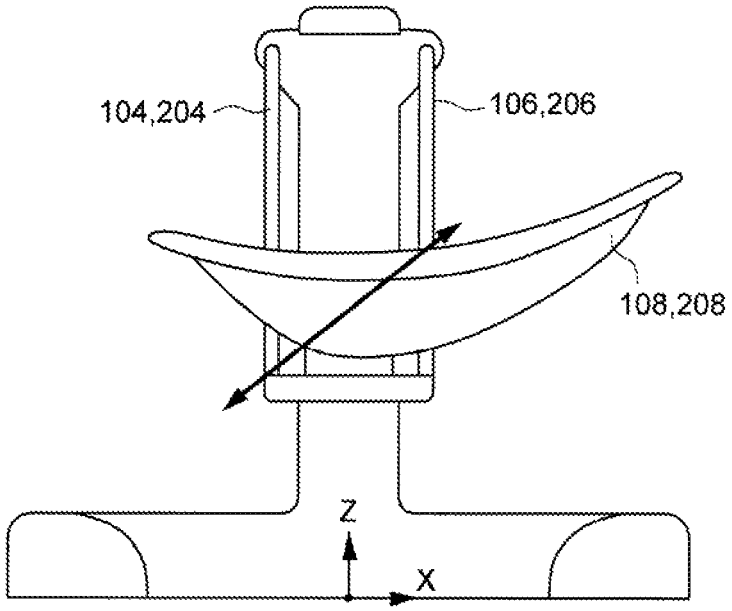
FIG. 15 is a schematic view illustrating a diagonal motion implemented in the child motion apparatus.

In FIG. 15, the arrow represents a "diagonal" motion in which the seat support 108, 208 travels along a linear path from a lowest point at the left end to a highest point at the right end.

Figure 16:
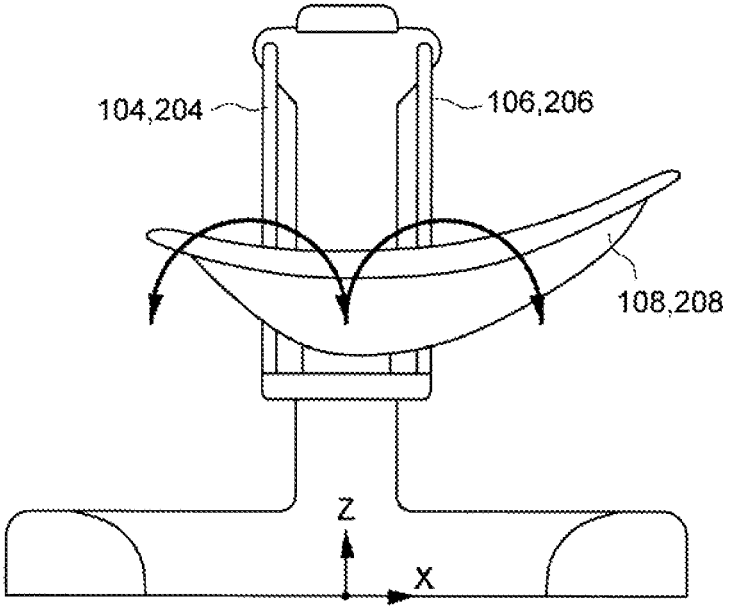
FIG. 16 is a schematic view illustrating a bounce motion implemented in the child motion apparatus.

In FIG. 16, the arrow represents a "bounce" motion in which the seat support 108, 208 can travel along a path that has three lower points at the left and right ends and a middle position between the left and right ends, and has an arc shape between each pair of adjacent lower points.

Figure 17:
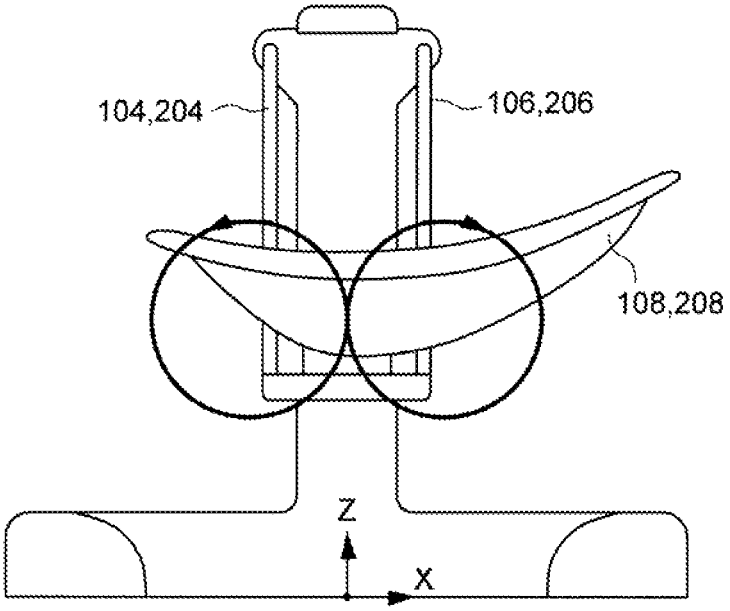
FIG. 17 is a schematic view illustrating a motion having an "8" shaped figure implemented in the child motion apparatus.

In FIG. 17, the arrow represents a motion in which the seat support 108, 208 travels along a "8-shaped" path in the vertical plane defined by the axes X and Z.

Advantages of the structures described herein include the ability to incorporate multiple drive systems in a child motion apparatus. The drive systems can be independently operable to move a seat support of the child motion apparatus with a broader range of swinging frequencies, speeds and motion paths.

Realizations of the child motion apparatuses have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. A child motion apparatus comprising:

an upright column defining a vertical axis;

a carriage assembled with the upright column, wherein the carriage includes a swing shaft portion operable to rotate about a pivot axis;

a swing arm affixed with the swing shaft portion;

a first motor drive unit assembled with the carriage and having an output shaft;

a drive transmission respectively connected with the output shaft and the swing shaft portion, wherein the drive transmission is operable to transfer a first output drive provided by the first motor drive unit at the output shaft to the swing shaft portion to impart rotation to the swing arm about the pivot axis;

a second motor drive unit assembled with the upright column; and an actuating mechanism respectively connected with the second motor drive unit and the carriage, wherein the actuating mechanism is drivable by the second motor drive unit to vertically move the carriage relative to the upright column.

2. The child motion apparatus according to claim 1, wherein the output shaft is substantially parallel to the pivot axis.

3. The child motion apparatus according to claim 1, further including:

a second swing arm that is affixed with a second swing shaft portion pivotally connected with the carriage; and a linkage member pivotally connected with the swing arm and the second swing arm, wherein a swing motion of the swing arm is transmitted to the second swing arm via the linkage member.

4. The child motion apparatus according to claim 3, wherein the carriage includes a roller capable of freely rotation that is in rolling contact with the linkage member at a location below the pivot axis.

5. The child motion apparatus according to claim 1, wherein the upright column includes a tube segment, and the carriage includes a plurality of roller bearings in rolling contact with the tube segment for facilitating up and down movements of the carriage along the tube segment.

6. The child motion apparatus according to claim 5, wherein the second motor drive unit is connected with the tube segment via a rubber bushing.

7. The child motion apparatus according to claim 1, wherein the swing shaft portion includes a radial extension projecting along a radial direction relative to the pivot axis, and the drive transmission includes:

a crank affixed with the output shaft; and a connecting rod having a first end portion pivotally connected with the crank, and a second end portion pivotally connected with the radial extension of the swing shaft portion.

8. The child motion apparatus according to claim 1, wherein the drive transmission includes a first gear operatively connected with the output shaft, a second gear member affixed with the swing shaft portion, and a double-gear member pivotally connected with the carriage and respectively meshed with the first gear and the second gear member.

9. The child motion apparatus according to claim 1, wherein the actuating mechanism includes:

a crank affixed with a second output shaft of the second motor drive unit; and a connecting rod having a first end portion pivotally connected with the crank, and a second end portion pivotally connected with the carriage.

10. The child motion apparatus according to claim 1, wherein the actuating mechanism includes:

a screw extending along the vertical axis and drivable in rotation by the second motor drive unit; and a threaded portion affixed with the carriage and meshed with the screw, wherein rotation of the screw causes up and down displacement of the carriage relative to the upright column.

11. The child motion apparatus according to claim 1, further including a spring having a first end connected with the carriage, and a second end connected with the upright column.

12. The child motion apparatus according to claim 11, wherein the spring is operable to apply an upward biasing force to the carriage.

13. The child motion apparatus according to claim 1, wherein the actuating mechanism includes a plurality of first component parts, and the drive transmission includes a plurality of second component parts, all of the first component parts of the actuating mechanism and all of the second component parts of the drive transmission move in vertical planes that are substantially parallel to a plane in which the swing arm moves.

14. The child motion apparatus according to claim 1, wherein at least one of the first and second motor drive units includes a motor having a motor shaft connected with a fan, the fan being operable to rotate with the motor shaft.

15. The child motion apparatus according to claim 14, wherein the motor is connected with a gear box, and the fan is operable to rotate with the motor shaft to draw air flow into the gear box.

16. The child motion apparatus according to claim 1, wherein at least one of the first and second drive units includes:

a motor having a motor shaft; and a gear box including a worm gear, and a gear meshed with the worm gear, wherein the worm gear is coupled with the motor shaft via a transmission belt.

17. The child motion apparatus according to claim 1, wherein the drive transmission includes a first crank and a first connecting rod, and the actuating mechanism includes a second crank and a second connecting rod, the first crank being affixed with the output shaft, the first connecting rod having a first and a second end portion respectively connected with the first crank and the swing shaft portion, the second crank being affixed with a second output shaft of the second motor drive unit, and the second connecting rod having a third and a fourth end portion respectively connected with the second crank and the carriage.

18. A child motion apparatus comprising:

an upright column having two spaced-apart tube segments parallel to each other;

a carriage assembled with the two tube segments, wherein the carriage includes a swing shaft portion operable to rotate about a pivot axis;

a swing arm affixed with the swing shaft portion;

a first motor drive unit assembled with the carriage;

a drive transmission respectively connected with the first motor drive unit and the swing shaft portion, wherein the drive transmission is drivable by the first motor drive unit to impart rotation to the swing arm about the pivot axis;

a second motor drive unit assembled with the two tube segments; and an actuating mechanism respectively connected with the second motor drive unit and the carriage, wherein the actuating mechanism is drivable by the second motor drive unit to cause up and down movements of the carriage along the two tube segments.

19. The child motion apparatus according to claim 18, wherein the first drive unit includes a motor, and a gear box connected with the motor and provided with an output shaft, and the drive transmission includes a crank affixed with the output shaft, and a connecting rod having two opposite ends respectively connected pivotally with the crank and the swing shaft portion.

20. The child motion apparatus according to claim 19, wherein the gear box includes a worm gear coupled with a motor shaft via a transmission belt, and a gear affixed with the output shaft and meshed with the worm gear.

21. The child motion apparatus according to claim 19, wherein the crank and the connecting rod respectively move in vertical planes that are substantially parallel to a plane in which the swing arm moves.

22. The child motion apparatus according to claim 18, wherein the second drive unit includes a motor, and a gear box connected with the motor and provided with an output shaft, and the actuating transmission includes a crank affixed with the output shaft, and a connecting rod having two opposite ends respectively connected pivotally with the crank and the carriage.

23. The child motion apparatus according to claim 22, wherein the gear box includes a worm gear coupled with a motor shaft via a transmission belt, and a gear affixed with the output shaft and meshed with the worm gear.

24. The child motion apparatus according to claim 22, wherein the crank and the connecting rod respectively move in vertical planes that are substantially parallel to a plane in which the swing arm moves.

25. The child motion apparatus according to claim 18, wherein the drive transmission includes a first gear operatively connected with the first motor drive unit, a second gear member affixed with the swing shaft portion, and a double-gear member pivotally connected with the carriage and respectively meshed with the first gear and the second gear member.

26. The child motion apparatus according to claim 18, wherein the actuating mechanism includes:

a screw extending along the vertical axis and drivable in rotation by the second motor drive unit; and a threaded portion affixed with the carriage and meshed with the screw, wherein rotation of the screw causes up and down displacement of the carriage along the two tube segments.

27. The child motion apparatus according to claim 18, further including a spring having a first end connected with the carriage, and a second end connected with one of the two tube segments.

28. The child motion apparatus according to claim 18, wherein at least one of the first and second motor drive units includes a motor having a motor shaft connected with a fan, and a gear box connected with the motor, the fan being operable to rotate with the motor shaft to draw air flow into the gear box.

29. The child motion apparatus according to claim 18, wherein the carriage includes a plurality of roller bearings in rolling contact with the two tube segments for facilitating up and down movements of the carriage along the two tube segments.

30. The child motion apparatus according to claim 18, further including:

a second swing arm that is affixed with a second swing shaft portion pivotally connected with the carriage; and a linkage member pivotally connected with the swing arm and the second swing arm, wherein a swing motion of the swing arm is transmitted to the second swing arm via the linkage member.

31. The child motion apparatus according to claim 30, wherein the carriage includes a roller capable of freely rotation that is in rolling contact with the linkage member at a location below the pivot axis.

* * * * *